US006915659B2

(12) United States Patent
Seno et al.

(10) Patent No.: US 6,915,659 B2
(45) Date of Patent: Jul. 12, 2005

(54) REFRIGERATION SYSTEM AND ITS CONDENSING APPARATUS

(75) Inventors: Yoshihiko Seno, Tochigi (JP); Osamu Kamoshida, Tochigi (JP); Keiji Yamazaki, Tochigi (JP)

(73) Assignee: Showa Denko K.K., Tokyo (JP)

( * ) Notice: Subject to any disclaimer, the term of this patent is extended or adjusted under 35 U.S.C. 154(b) by 62 days.

(21) Appl. No.: 10/486,209

(22) PCT Filed: Feb. 20, 2003

(86) PCT No.: PCT/JP03/01845

§ 371 (c)(1),
(2), (4) Date: Feb. 17, 2004

(87) PCT Pub. No.: WO03/071201

PCT Pub. Date: Aug. 28, 2003

(65) Prior Publication Data

US 2004/0200234 A1 Oct. 14, 2004

Related U.S. Application Data

(60) Provisional application No. 60/363,285, filed on Mar. 12, 2002.

(30) Foreign Application Priority Data

Feb. 20, 2002 (JP) ..... 2002-043367

(51) Int. Cl.[7] ..... F25B 39/04
(52) U.S. Cl. ..... 62/509; 62/529; 165/175
(58) Field of Search ..... 62/509, 498, 529; 165/132, 174, 175

(56) References Cited

U.S. PATENT DOCUMENTS 5,546,761 A * 8/1996 Matsuo et al. ..... 62/509
5,868,002 A * 2/1999 Matsubayashi ..... 62/507
5,946,940 A * 9/1999 Inoue ..... 62/509
6,000,465 A * 12/1999 Kawahara ..... 165/132
6,158,503 A 12/2000 Gille et al.
6,295,832 B1 * 10/2001 Kato et al. ..... 62/509
6,330,810 B1 * 12/2001 Yamazaki et al. ..... 62/509
6,334,333 B1 * 1/2002 Shinhama ..... 62/509
6,397,627 B1 * 6/2002 Aki et al. ..... 62/509
6,470,703 B2 * 10/2002 Wada et al. ..... 62/509
6,470,704 B2 * 10/2002 Shibata et al. ..... 62/509

FOREIGN PATENT DOCUMENTS

JP 11316065 11/1999
JP 02001133077 A * 5/2001
JP 02001208450 A * 8/2001
JP 02001227843 A * 8/2001

* cited by examiner

*Primary Examiner*—William E. Tapoalcai
*Assistant Examiner*—Mohammad M. Ali
(74) *Attorney, Agent, or Firm*—Oblon, Spivak, McClelland, Maier & Neustadt, P.C.

(57) ABSTRACT

A heat exchanger with a receiver-tank includes a heat exchanger main body, a receiver-tank and a block flange. The flange includes a main body, an embedding portion to be attached to one of headers in an embedded state, an inlet flow passage with an inlet side end portion disposed at an upper end of the embedding portion, the inlet flow passage communicating with a condensing portion of the heat exchanger main body, and an outlet flow passage with an outlet side end portion disposed at a side surface of the embedding portion, and the outlet flow passage communicating with a subcooling portion. A flange-like partition piece is formed at an upper end periphery of the embedding portion of the flange, and the peripheral edge of the partition piece is joined to the inner peripheral surface of one of the headers.

41 Claims, 7 Drawing Sheets

REFRIGERATION SYSTEM AND ITS CONDENSING APPARATUS

Priority is claimed to Japanese Patent Application No. 2002-43367 filed on Feb. 20, 2002 and a U.S. Provisional Patent Application No. 60/363,285 filed on Mar. 12, 2002, the disclosure of which are incorporated by reference in their entireties.

CROSS REFERENCE TO RELATED APPLICATIONS

This application is an application filed under 35 U.S.C. § 111(a) claiming the benefit pursuant to 35 U.S.C. § 119(e)(1) of the filing date of U.S. Provisional Application No. 60/363,285 filed on Mar. 12, 2002 pursuant to 35 U.S.C. § 111(b).

TECHNICAL FIELD

The present invention relates to a condensing apparatus including a heat exchanger with a receiver-tank, a receiver-tank joint member, receiver-tank assembling structure of a heat exchanger suitably used for, for example, a car air-conditioning refrigeration apparatus, and also relates to a refrigeration system.

BACKGROUND ART

In recent years, in a condensing process of a refrigerant in a refrigeration cycle for a car air-conditioning system or the like, a technique for subcooling a condensed refrigerant to a temperature lower than the condensing temperature by several degrees is proposed. In this technique, the refrigerant whose heat releasing amount was increased by the subcooling is introduced to a decompressing means and an evaporator so as to increase the heat absorption amount at the time of the refrigerant evaporation, to thereby improve the refrigeration capacity.

In performing this proposed technique, a heat exchanger with a receiver-tank (subcool system condenser) in which a receiver-tank is attached to a heat exchanger integrally provided with a condensing portion and a subcooling portion is now under development.

As shown in FIG. 8, in this heat exchanger with a receiver-tank, a heat exchanger main body 100 includes a pair of headers 101 and 101 and a plurality of heat exchanging tubes 100 disposed in parallel with their opposite ends communicated with the headers. The heat exchanging tubes are classified into a plurality of passes P1 to P5 by partitions 102 provided in the headers 101. The passes P1–P3 constitute a condensing portion 110, and the passes P4 and P5 constitute a subcooling portion 120 independent to the condensing portion 110.

A condensing portion inlet 111 and a condensing portion outlet 112 are provided at the upper and lower portions of the condensing portion 110 of the header 101, respectively. A subcooling portion inlet 121 and a subcooling portion outlet 122 are provided at the upper and lower portions of the subcooling portion 120 of the header 101, respectively.

A receiver-tank 130 attached to the header 101 is provided with a receiver-tank inlet 131 communicated with the condensing portion outlet 112 and a receiver tank outlet 132 communicated with the subcooling portion inlet 121.

In this heat exchanger with a receiver-tank, the gaseous refrigerant flowed into the condensing portion 110 from the condensing portion inlet 111 is condensed by exchanging heat between the refrigerant and the ambient air while passing through each of the passes P1 to P3 of the condensing portion 110. The condensed refrigerant is introduced into the receiver-tank 130 via the condensing portion outlet 112 and the receiver-tank inlet 131, and once stored in the receiver-tank. Then, only the liquefied refrigerant is introduced into the subcooling portion 120 via the receiver tank outlet 132 and the subcooling portion inlet 121. Furthermore, the liquefied refrigerant flowed into the subcooling portion 120 is subcooled by the ambient air while passing through the fourth and fifth passes P4 and P5, and then flows out of the subcooling portion outlet 122.

In the heat exchanger integrally provided with such a receiver-tank, for example, as shown in FIG. 9, the receiver-tank 130 is connected to the heat exchanger main body 100 via a joint member such as a block flange 140.

This flange 140 is integrally provided with a first block 151 joined to the condensing portion outlet 112 or the vicinity thereof of one of the headers 101 of the heat exchanger main body 100 and a second block 152 joined to the subcooling portion inlet 131 or the vicinity thereof. The first block 151 is provided with an inlet flow passage 141 having one end (outlet side end portion) opened to the flange upper surface and the other end (inlet side end portion) communicating with the condensing portion outlet 112. The second block 152 is provided with an outlet flow passage 142 having one end (inlet side end portion) opened to the flange upper surface and the other end (outlet side end portion) communicating with the subcooling portion inlet 121.

On the other hand, the receiver-tank 130 is provided with a lower end closing member 136 having a receiver-tank inlet 131 and a receiver tank outlet 132 each communicating with the inside of the tank.

The receiver-tank inlet and outlet 131 and 131 are joined to and communicated with the end portions of the inlet flow passage 141 and the outlet flow passage 142 of the block flange 140 via joint pipes 145 and 145, respectively. In this joined state, the receiver-tank 140 is attached to the upper surface of the block flange 140.

In the refrigeration system for a car air-conditioner to which the aforementioned heat exchanger with a receiver-tank is applied, it is required to be small in size and light in weight in order to effectively use the limited space in a car body.

However, when making the receiver-tank 130 smaller, the tank volume becomes smaller, and therefore the stable range of the refrigerant, i.e., the stable range in the subcooling state of the refrigerant with respect to the amount of sealed refrigerant becomes narrower. This tends to cause an excessive or shortage of sealed amount of refrigerant, resulting in unstable refrigeration performance.

Furthermore, when making the heat exchanger main body 100 smaller, the core area for refrigerant condensation becomes smaller. This makes it difficult to stably supply a liquefied refrigerant, resulting in poor refrigeration performance.

On the other hand, in the condensing apparatus such as the aforementioned heat exchanger with a receiver-tank or a refrigeration system, it is actually required to decrease the number of parts, improve the workability and decrease the costs besides the aforementioned miniaturization.

It is an object of the present invention to solve the problems of the aforementioned prior art, provide a condensing apparatus such as a heat exchanger with a receiver-tank etc. capable of miniaturizing, obtaining stable refrigeration performance, decreasing the number of parts and the costs and improving assembling workability, and to provide a refrigeration system.

DISCLOSURE OF INVENTION

<First Invention>

In order to attain the aforementioned object, the first invention has the following structure.

[1] A heat exchanger with a receiver-tank, comprising:

a heat exchanger main body including a pair of headers and a plurality of heat exchanging tubes disposed in parallel with opposite ends thereof communicated with the headers, wherein a refrigerant is condensed by a condensing portion constituted by the heat exchanging tubes;

a receiver-tank provided with a receiver-tank inlet and a receiver-tank outlet at a lower end thereof, wherein the refrigerant introduced via the receiver-tank inlet is stored and only the liquefied refrigerant flows out of the receiver-tank outlet; and a joint member for connecting the receiver-tank to one of the pair of headers, wherein the joint member includes a joint member main body to be attached to a lower end of the receiver-tank, an embedding portion provided at a side portion of the joint main body to be embedded in the one of the pair of headers, and an inlet flow passage having an inlet side end portion disposed at an upper end surface of the embedding portion to be communicated with the condensing portion and an outlet side end portion disposed at an upper end surface of the joint member main body to be communicated with the receiver-tank inlet, wherein a flange-like partition piece protruded outwardly is integrally formed at an upper end periphery of the embedding portion of the joint member, a peripheral edge of the flange-like partition piece being joined to an inner peripheral surface of the one of the pair of headers, and an inside of the one of the pair of headers being divided by the flange-like partition piece, and whereby the refrigerant condensed by the condensing portion is introduced into an inside of the receiver-tank via the inlet side end portion of the inlet flow passage in the joint member.

In the heat exchanger with a receiver-tank of the first invention, since the embedding portion of the receiver-tank joint member is secured to one of the headers in the state where the embedding portion is embedded in one of the headers, the installation space of the embedding portion can be omitted. Furthermore, since the flange-like partition piece is integrally provided at the inlet or its vicinity of the inlet flow passage at the upper end surface of the embedding portion to thereby divide the inside of one of the headers, it is not necessary to attach an additional partition for dividing the inside of the header, and therefore the number of components can be decreased.

Furthermore, since a part of the joint member is embedded in one of the headers, the receiver-tank to be attached to the joint member can be further approached to the header. Thus, the miniaturization can be attained.

In the first invention, it is preferable to employ the following [2] to [6] structures.

[2] The heat exchanger with a receiver-tank as recited in [1], wherein the outlet side end portion of the inlet flow passage of the joint member is positioned lower than the inlet side end portion.

In this structure, the assembling position of the receiver-tank can be positioned lower. Thus, a longer receiver-tank can be used, which enables to keep the tank volume large enough.

[3] The heat exchanger with a receiver-tank as recited in [1], wherein an inlet side half portion of the inlet flow passage of the joint member is formed as a refrigerant descent passage for descending the refrigerant downward.

In this structure, the assembling position of the receiver-tank can be assuredly positioned lower.

[4] The heat exchanger with a receiver-tank as recited in [3], wherein the refrigerant descent passage is disposed so that a passage direction thereof is inclined to an axis of the one of the pair of headers.

In this structure, since the upper end opening area of the descent passage can be formed larger as compared with the case where a passage is disposed in parallel to the axis of the header, the refrigerant can be introduced smoothly and efficiently, and therefore the pressure loss of the refrigerant can be reduced.

[5] The heat exchanger with a receiver-tank as recited in [1], wherein an outlet side half portion of the inlet flow passage of the joint member is formed as a refrigerant ascent passage for raising the refrigerant upward.

In this structure, since the refrigerant can be introduced into the receiver-tank in a stabilized manner, and therefore the vapor-liquid-separation performance by the receiver-tank can be improved.

[6] The heat exchanger with a receiver-tank as recited in [5], wherein the refrigerant ascent passage is disposed so that a passage direction thereof is approximately parallel to an axis of the one of the pair of headers.

In this structure, the refrigerant can be introduced into the receiver-tank in a further stabilized manner, and therefore the vapor-liquid-separation performance can be further improved.

<Second Invention>

The second invention is directed to the so-called subcool system condenser having a subcooling portion in the heat exchanger main body, and has the following structure.

[7] A heat exchanger with a receiver-tank, comprising:

a heat exchanger main body including a pair of headers and a plurality of heat exchanging tubes disposed in parallel with opposite ends thereof communicated with the headers, wherein an inside of each of the headers is divided at the same height to thereby form an upper side condensing portion and a lower side subcooling portion;

a receiver-tank provided with a receiver-tank inlet and a receiver-tank outlet at a lower end thereof, wherein the refrigerant introduced via the receiver-tank inlet is stored and only the liquefied refrigerant flows out of the receiver-tank outlet; and a joint member for connecting the receiver-tank to one of the pair of headers, wherein the joint member includes a joint member main body to be attached to a lower end of the receiver-tank, an embedding portion provided at a side portion of the joint member main body to be embedded in the one of the pair of headers, an inlet flow passage having an inlet side end portion disposed at an upper end surface of the embedding portion to be communicated with the condensing portion and an outlet side end portion disposed at an upper end surface of the joint member main body to be communicated with the receiver-tank inlet, and an outlet flow passage having an inlet side end portion disposed at an upper end surface of the joint member main body to be communicated with the receiver-tank outlet and an outlet side end portion disposed at a portion below the embedding portion to be communicated with the subcooling portion, wherein a flange-like partition piece protruded outwardly is integrally formed at an upper end periphery of the embedding portion of the joint member, the flange-like partition piece constituting as the partition of the one of the pair of headers, whereby the refrigerant condensed by the condensing portion is introduced into an inside of the receiver-tank via the inlet side end portion of the inlet flow passage in the joint member, and the refrigerant in the receiver-tank is introduced into the subcooling portion from the outlet side end portion of the outlet flow passage through the outlet flow passage of the joint member.

In this second invention too, the same functions and effects as mentioned above can be obtained.

In the second invention, it is preferable to employ the following structure [8] to [13] in the similar manner as mentioned above.

[8] The heat exchanger with a receiver-tank as recited in [7], wherein the outlet side end portion of the inlet flow passage of the joint member is positioned lower than the inlet side end portion.

[9] The heat exchanger with a receiver-tank as recited in [7], wherein the outlet side end portion of the inlet flow passage of the joint member is disposed at a height corresponding to the subcooling portion.

[10] The heat exchanger with a receiver-tank as recited in [7], wherein an inlet side half portion of the inlet flow passage of the joint member is formed as a refrigerant descent passage for downwardly descending the refrigerant.

[11] The heat exchanger with a receiver-tank as recited in [10], wherein the refrigerant descent passage is disposed so that a passage direction thereof is inclined to an axis of the one of the pair of headers.

[12] The heat exchanger with a receiver-tank as recited in [7], wherein an outlet side half portion of the inlet flow passage of the joint member is formed as a refrigerant ascent passage for raising the refrigerant upward.

[13] The heat exchanger with a receiver-tank as recited in [12], wherein the refrigerant ascent passage is disposed so that a passage direction thereof is approximately parallel to an axis of the one of the pair of headers.

<Third Invention>

The third invention specifies the receiver-tank applicable to the first invention, and has the following structure.

[14] A receiver-tank joint member for connecting a receiver-tank for storing a liquefied refrigerant to a heat exchanger main body including a pair of headers and a plurality of heat exchanging tubes arranged in parallel with opposite ends thereof communicated with the headers, the heat exchanger main body having a condensing portion formed by the plurality of heat exchanging tubes, the receiver-tank joint member, comprising:

a joint member main body to which a lower end of the receiver-tank is to be attached;

an embedding portion provided at a side portion of the joint member main body to be embedded in one of the pair of headers;

an inlet flow passage for communicating the condensing portion with the receiver-tank inlet at a lower end of the receiver-tank, the inlet flow passage having an inlet side end portion disposed at an upper end surface of the embedding portion and an outlet side end portion disposed at an upper end surface of the joint member main body; and a flange-like partition piece for dividing an inside of the one of the pair of headers, the flange-like partition piece being integrally protruded outwardly at an upper periphery of the embedding portion, the peripheral edge of the flange-like piece being joined to an inner peripheral surface of the one of the pair of headers.

When the receiver-tank joint member of this third invention is applied to a heat exchanger with a receiver-tank, the same functions and effects as the first invention can be obtained.

In the third invention, it is preferable to employ the following structure [15] to [19].

[15] The receiver-tank joint member as recited in [14], wherein the outlet side end portion of the inlet flow passage is positioned lower than the inlet side end portion.

[16] The receiver-tank joint member as recited in [14], wherein an inlet side half portion of the inlet flow passage is formed as a refrigerant descent passage for downwardly descending the refrigerant.

[17] The receiver-tank joint member as recited in [16], wherein the refrigerant descent passage is disposed so that a passage direction thereof is inclined to an axis of the one of the pair of headers.

[18] The receiver-tank joint member as recited in [14], wherein an outlet side half portion of the inlet flow passage is formed as a refrigerant ascent passage for raising the refrigerant upward.

[19] The receiver-tank joint member as recited in [18], wherein the refrigerant ascent passage is disposed so that a passage direction thereof is approximately parallel to an axis of the one of the pair of headers.

<Fourth Invention>

The fourth invention specifies a receiver-tank joint member applicable to the second invention, and has the following structure.

[20] A receiver-tank joint member for connecting a receiver-tank for storing a liquefied refrigerant to a heat exchanger main body including a pair of headers and a plurality of heat exchanging tubes arranged in parallel with opposite ends thereof communicated with the headers, the heat exchanger main body having an upper condensing portion and a lower subcooling portion divided by partitions provided at the same level, the receiver-tank joint member, comprising:

a joint member main body to which a lower end of the receiver-tank is to be attached;

an embedding portion provided at a side portion of the joint member main body to be embedded in one of the pair of headers;

an inlet flow passage for communicating the condensing portion with the receiver-tank inlet at a lower end of the receiver-tank, the inlet flow passage having an inlet side end portion disposed at an upper end surface of the embedding portion and an outlet side end portion disposed at an upper end surface of the joint member main body;

an outlet flow passage for communicating the receiver-tank outlet at a lower end of the receiver-tank with the subcooling portion, the inlet flow passage having an inlet side end portion disposed at an upper end surface of the joint member main body and an outlet side end portion disposed at a portion below the embedded portion; and a flange-like partition piece constituting the partition in the one of the pair of headers, the flange-like partition piece being integrally protruded outwardly at an upper periphery of the embedding portion.

When the receiver-tank joint member of this fourth invention is applied to a heat exchanger with a receiver-tank, the same functions and effects as the second invention can be obtained.

In this fourth invention, it is preferable to employ the following structure [21] to [26].

[21] The receiver-tank joint member as recited in [20], wherein the outlet side end portion of the inlet flow passage is positioned lower than the inlet side end portion.

[22] The receiver-tank joint member as recited in [20], wherein the outlet side end portion of the inlet flow passage is positioned at a height corresponding to the subcooling portion.

[23] The receiver-tank joint member as recited in [20], wherein an inlet side half portion of the inlet flow passage is formed as a refrigerant descent passage for downwardly descending the refrigerant.

[24] The receiver-tank joint member as recited in [23], wherein the refrigerant descent passage is disposed so that a passage direction thereof is inclined to an axis of the one of the pair of headers.

[25] The receiver-tank joint member as recited in [20], wherein an outlet side half portion of the inlet flow passage is formed as a refrigerant ascent passage for raising the refrigerant upward.

[26] The receiver-tank joint member as recited in [25], wherein the refrigerant ascent passage is disposed so that a passage direction thereof is approximately parallel to an axis of the one of the pair of headers.

<Fifth Invention>

The fifth invention specifies the receiver-tank assembling structure for a heat exchanger applicable to the first invention, and has the following structure.

[27] A receiver-tank assembling structure of a heat exchanger for assembling a receiver-tank for storing a liquefied-refrigerant to a heat exchanger main body including a pair of headers and a plurality of heat exchanging tubes arranged in parallel with opposite ends thereof communicated with the headers, the heat exchanging tubes constituting a condensing portion, the receiver-tank assembling structure, comprising:

a joint member including a joint member main body and an embedding portion provided at a side portion of the main body, wherein the joint member is provided with an inlet flow passage with an inlet side end portion disposed at an upper end surface of the embedding portion and an outlet side end portion disposed at an upper end surface of the joint member main body and a flange-like partition piece integrally protruded from an upper end periphery of the embedding portion, wherein the joint member is attached to the one of the pair of headers in the state that the embedded portion is embedded in the one of the pair of headers, and a peripheral edge of the flange-like partition piece is joined to an inner peripheral surface of the one of the pair of headers so that an inside of the one of the pair of headers is divided by the flange-like partition piece, and wherein a lower end of the receiver-tank is attached to the joint member main body, whereby the condensing portion communicates with the receiver-tank inlet at a lower end of the receiver-tank by the inlet flow passage.

When the receiver-tank assembling structure of a heat exchanger of this fifth invention is applied to a heat exchanger with a receiver-tank, the same functions and effects as the first invention can be obtained.

In this fifth invention, it is preferable to employ the following structure [28] to [32].

[28] The receiver-tank assembling structure as recited in [27], wherein the outlet side end portion of the inlet flow passage is positioned lower than the inlet side end portion.

[29] The receiver-tank assembling structure as recited in [26], wherein an inlet side half portion of the inlet flow passage is formed as a refrigerant descent passage for downwardly descending the refrigerant.

[30] The receiver-tank assembling structure as recited in [29], wherein the refrigerant descent passage is disposed so that a passage direction thereof is inclined to an axis of the one of the pair of headers.

[31] The receiver-tank assembling structure as recited in [27] , wherein an outlet side half portion of the inlet flow passage is formed as a refrigerant ascent passage for raising the refrigerant upward.

[32] The receiver-tank assembling structure as recited in [31], wherein the refrigerant ascent passage is disposed so that a passage direction thereof is approximately parallel to an axis of the one of the pair of headers.

<Sixth Invention>

The sixth invention specifies the receiver-tank assembling structure of a heat exchanger applicable to the second invention, and has the following structure.

[33] A receiver-tank assembling structure of a heat exchanger for assembling a receiver-tank for storing a liquefied-refrigerant to a heat exchanger main body including a pair of headers and a plurality of heat exchanging tubes arranged in parallel with opposite ends thereof communicated with the headers, the heat exchanger main body having an upper condensing portion and a lower subcooling portion divided by a partition disposed in an inside of the headers at the same height, the receiver-tank assembling structure, comprising:

a joint member including a joint member main body and an embedding portion provided at a side portion of the main body, wherein the joint member is provided with an inlet flow passage with an inlet side end portion disposed at an upper end surface of the embedding portion and an outlet side end portion disposed at an upper end surface of the joint member main body, an outlet flow passage with an inlet side end portion disposed at an upper end surface of the joint member main body and an outlet side end portion disposed at a portion below the embedding portion, and a flange-like partition piece integrally protruded from an upper end periphery of the embedding portion, wherein the joint member is attached to the one of the pair of headers in the state that the embedded portion is embedded in the one of the pair of headers and a peripheral edge of the flange-like partition piece is joined to an inner peripheral surface of the one of headers so that the flange-like partition constitutes as the partition in the one of the pair of headers, and wherein a lower end of the receiver-tank is attached to the joint member main body, whereby the condensing portion communicates with the receiver-tank inlet at a lower end of the receiver-tank via the inlet flow passage, and the receiver-tank outlet at a lower end of the receiver-tank communicates with the subcooling portion via the outlet flow passage.

When the receiver-tank assembling structure of the heat exchanger of this sixth invention is applied to a heat exchanger with a receiver-tank, the same functions and effects as the second invention can be obtained.

In this sixth invention, it is preferable to employ the following structure [34] to [39].

[34] The receiver-tank assembling structure as recited in [33], wherein the outlet side end portion of the inlet flow passage is positioned lower than the inlet side end portion.

[35] The receiver-tank assembling structure as recited in [33], wherein the outlet side end portion of the inlet flow passage is positioned at a height corresponding to the subcooling portion.

[36] The receiver-tank assembling structure as recited in [33], wherein an inlet side half portion of the inlet flow passage is formed as a refrigerant descent passage for downwardly descending the refrigerant.

[37] The receiver-tank assembling structure as recited in [36], wherein the refrigerant descent passage is disposed so that a passage direction thereof is inclined to an axis of the one of the pair of headers.

[38] The receiver-tank assembling structure as recited in [33], wherein an outlet side half portion of the inlet flow passage is formed as a refrigerant ascent passage for raising the refrigerant upward.

[39] The receiver-tank assembling structure as recited in [38], wherein the refrigerant ascent passage is disposed so that a passage direction thereof is approximately parallel to an axis of the one of the pair of headers.

<Seventh Invention>

The seventh invention specifies the refrigeration system applied to the heat exchanger with a receiver-tank of the first invention, and has the following structure.

[40] A refrigeration system in which a refrigerant compressed by a compressor is condensed by a heat exchanger with a receiver-tank, the condensed refrigerant is passed through a decompressing device to be decompressed and the decompressed refrigerant is evaporated by an evaporator and then returned to the compressor, wherein the heat exchanger with a receiver-tank comprises:

a heat exchanger main body including a pair of headers and a plurality of heat exchanging tubes disposed in parallel with opposite ends thereof communicated with the headers, wherein a refrigerant is condensed by a condensing portion constituted by the heat exchanging tubes;

a receiver-tank provided with a receiver-tank inlet and a receiver-tank outlet at a lower end thereof, wherein the refrigerant introduced via the receiver-tank inlet is stored and only the liquefied refrigerant flows out of the receiver-tank outlet; and a joint member for connecting the receiver-tank to one of the pair of headers, wherein the joint member includes a joint member main body to be attached to a lower end of the receiver-tank, an embedding portion provided at a side portion of the joint main body to be embedded in the one of the pair of headers, and an inlet flow passage having an inlet side end portion disposed at an upper end surface of the embedding portion to be communicated with the condensing portion and an outlet side end portion disposed at an upper end surface of the joint member main body to be communicated with the receiver-tank inlet, wherein a flange-like partition piece protruded outwardly is integrally formed at the upper end periphery of the embedding portion of the joint member, a peripheral edge of the flange-like partition piece being joined to an inner peripheral surface of the one of the pair of headers, and an inside of the one of the pair of headers being divided by the flange-like partition piece.

Since the refrigeration system of the seventh invention is applied to the heat exchanger with a receiver-tank of the first invention, the functions and effects similar to those of the first invention can be obtained.

In the refrigeration system of the seventh invention, the structure corresponding to the aforementioned structure [2] to [6] can be preferably employed.

<Eighth Invention>

The eighth invention specifies the refrigeration system to which the heat exchanger with a receiver-tank of the second invention is applied, and has the following structure.

[41] A refrigeration system in which a refrigerant compressed by a compressor is condensed by a heat exchanger with a receiver-tank, the condensed refrigerant is passed through a decompressing device to be decompressed and the decompressed refrigerant is evaporated by an evaporator and then returned to the compressor, wherein the heat exchanger with a receiver-tank comprises:

a heat exchanger main body including a pair of headers and a plurality of heat exchanging tubes disposed in parallel with opposite ends thereof communicated with the headers, wherein an inside of each of the headers is divided at the same height to thereby form an upper side condensing portion and a lower side subcooling portion;

a receiver-tank provided with a receiver-tank inlet and a receiver-tank outlet at a lower end thereof, wherein the refrigerant introduced via the receiver-tank inlet is stored and only the liquefied refrigerant flows out of the receiver-tank outlet; and a joint member for connecting the receiver-tank to one of the pair of headers, wherein the joint member includes a joint member main body to be attached to a lower end of the receiver-tank, an embedding portion provided at a side portion of the joint main body to be embedded in the one of the pair of headers, an inlet flow passage having an inlet side end portion disposed at an upper end surface of the embedding portion to be communicated with the condensing portion and an outlet side end portion disposed at an upper end surface of the joint member main body to be communicated with the receiver-tank inlet, and an outlet flow passage having an inlet side end portion disposed in an upper end surface of the joint member main body to be communicated with the receiver-tank outlet and an outlet side end portion disposed at a portion below the embedding portion to be communicated with the subcooling portion, wherein a flange-like partition piece protruded outwardly is integrally formed at an upper end periphery of the embedding portion of the joint member, the flange-like partition piece constituting the partition of the one of the pair of headers.

Since the refrigeration system of this eighth invention is applied to the heat exchanger with a receiver-tank of the second invention, the same functions and effects as the second invention can be obtained.

In the refrigeration system of this eighth invention, the structure corresponding to the aforementioned [8] to [13] can be suitably employed.

Other objects and advantages of the present invention will be apparent from the following preferred embodiments.

BEST MODE FOR CARRYING OUT THE INVENTION

Figure 1:
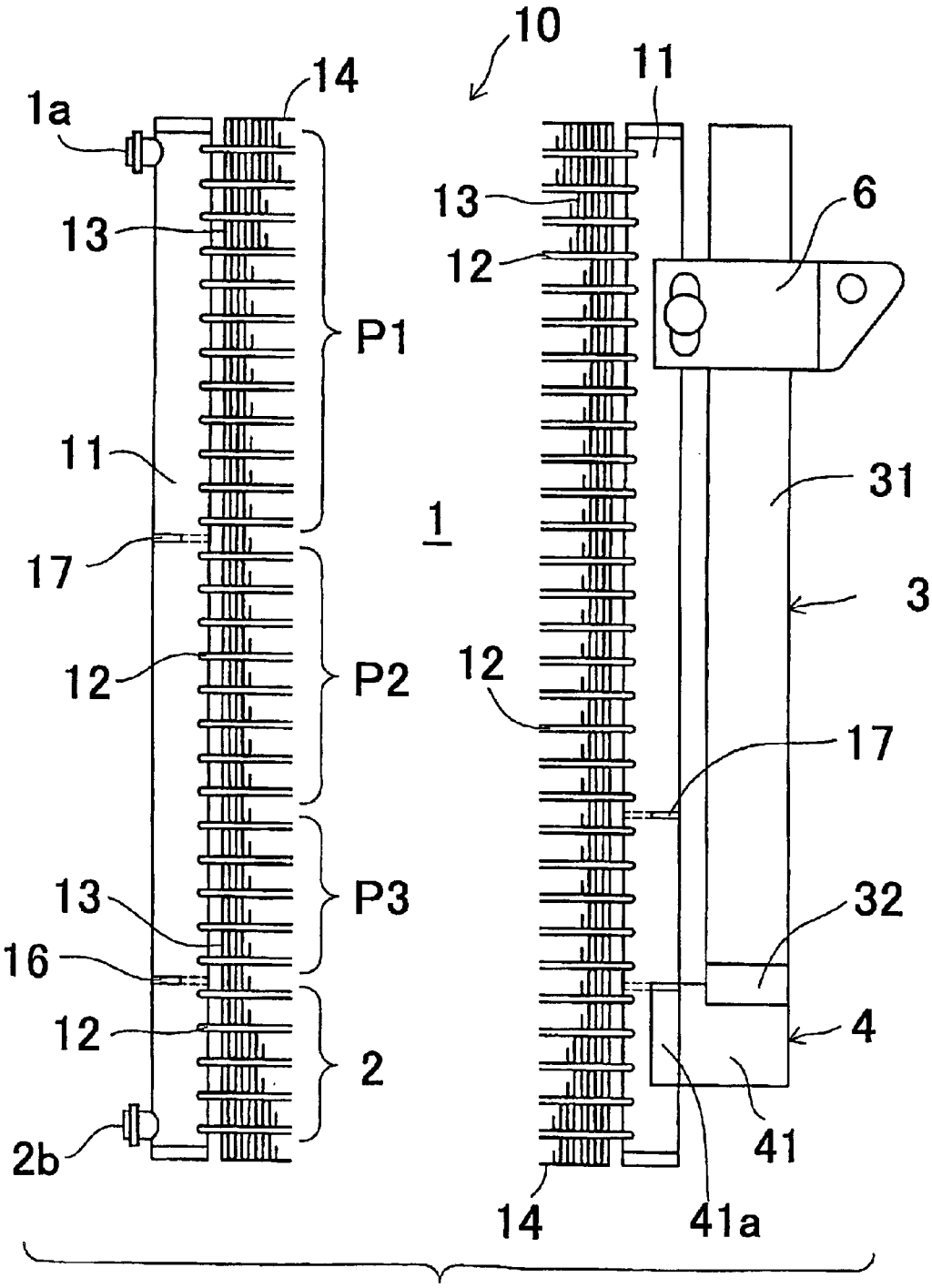
FIG. 1 is a front view showing the both side portions of the heat exchanger with a receiver-tank according to an embodiment of the present invention.
Figure 2:
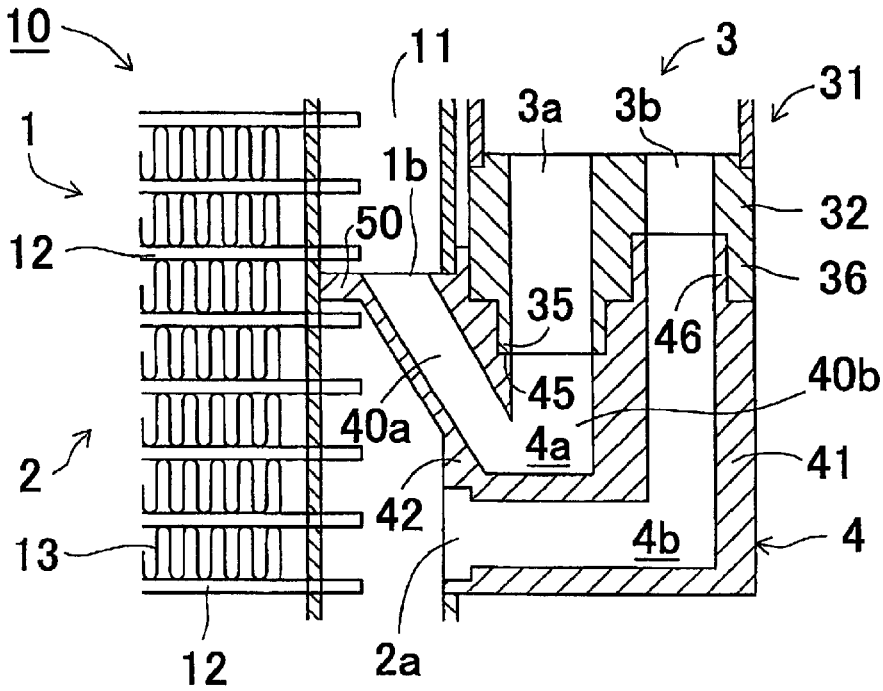
FIG. 2 is an enlarged front cross-sectional view showing the block flange and its vicinity of the heat exchanger of the embodiment.
Figure 3:
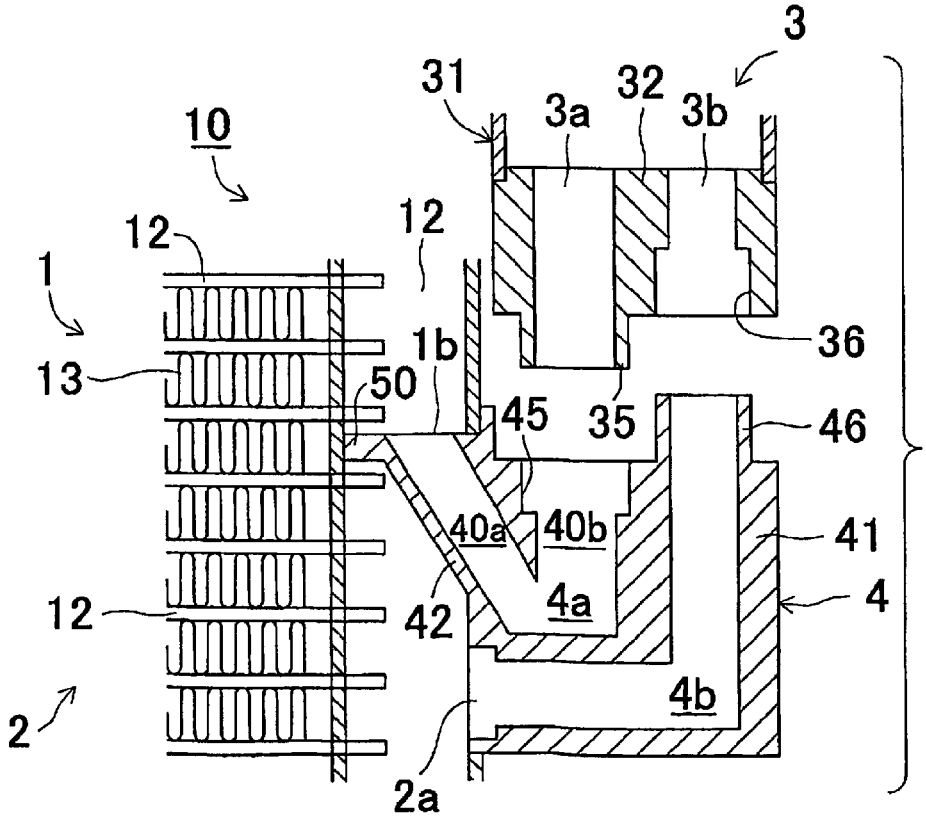
FIG. 3 is an exploded front cross-sectional view showing the block flange and its vicinity of the heat exchanger of the embodiment.
Figure 4:
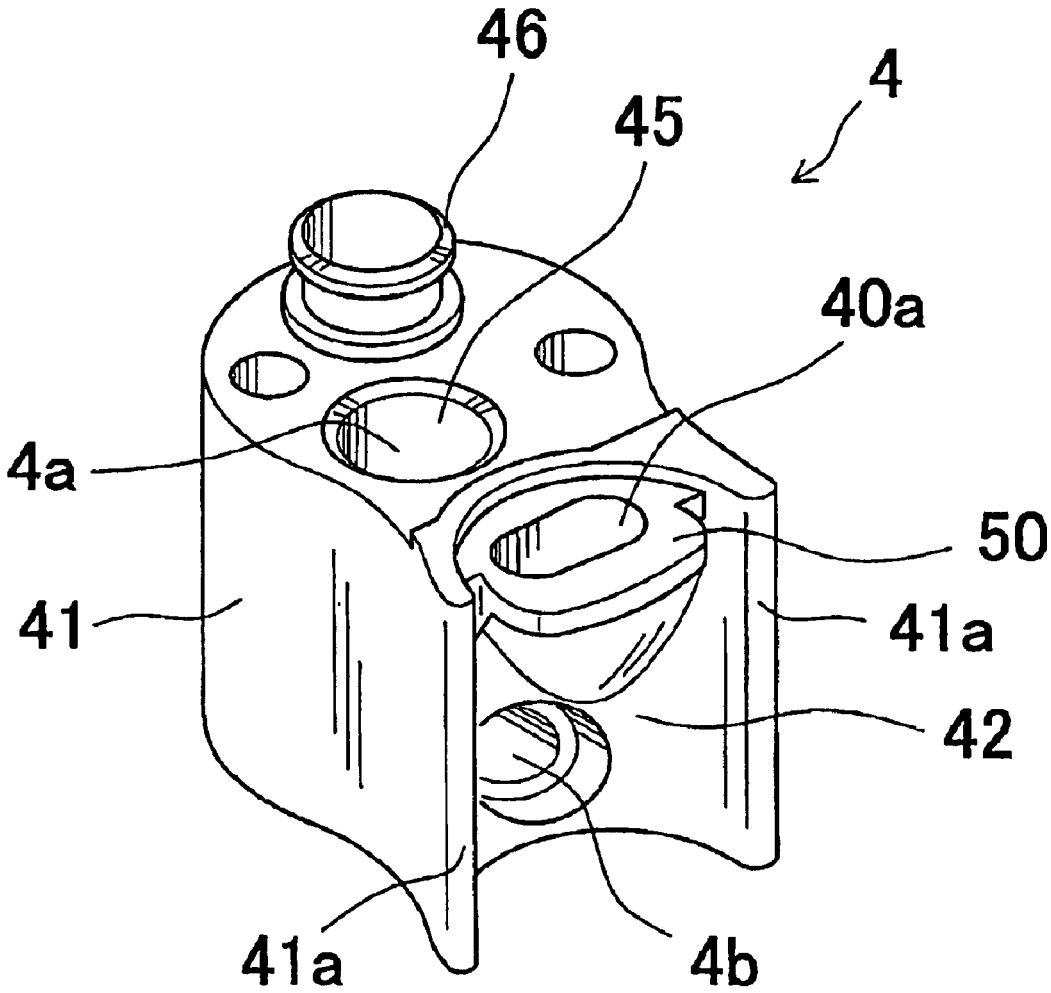
FIG. 4 is a perspective view showing the block flange of the embodiment.
Figure 5:
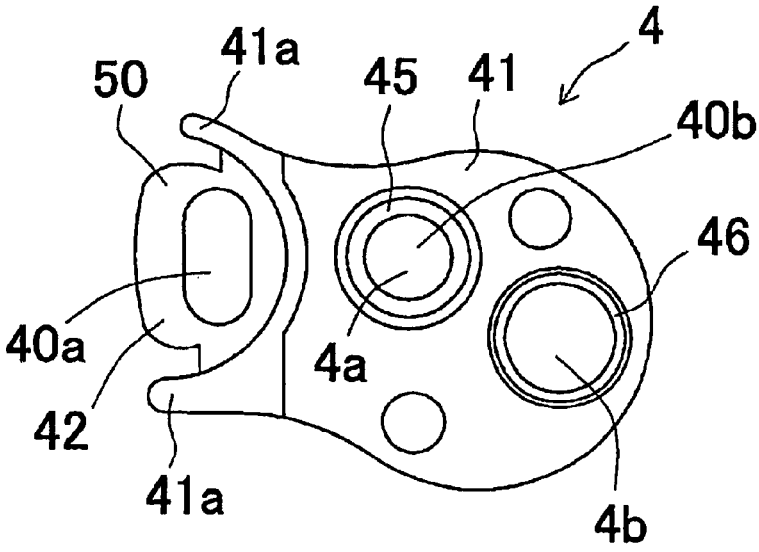
FIG. 5 is a plan view showing the block flange of the embodiment.
Figure 6:
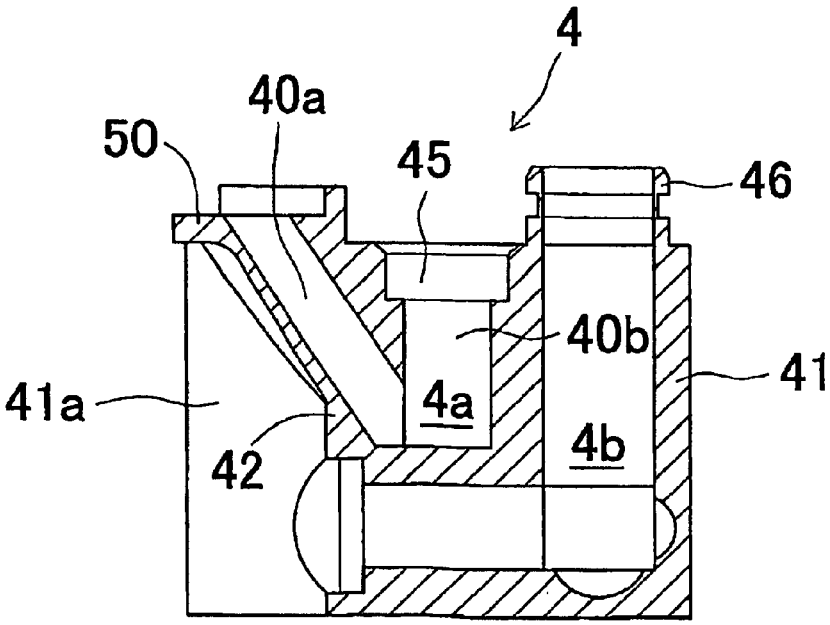
FIG. 6 is a cross-sectional view showing the block flange of the embodiment.

FIG. 1 is a front view showing the both side portions of the heat exchanger with a receiver-tank according to an embodiment of the present invention, FIG. 2 is an enlarged front cross-sectional view showing the block flange and its vicinity of the heat exchanger of the embodiment, and FIG. 3 is an exploded front cross-sectional view showing the block flange and its vicinity of the heat exchanger of the embodiment.

As shown in these figures, this heat exchanger is provided with a multi-flow type heat exchanger main body 10, a receiver-tank 3 and a block flange 4 constituting a joint member for connecting the receiver-tank 3 to the heat exchanger main body 10.

The heat exchanger main body 10 includes a pair of right and left vertical headers 11 disposed at a certain distance. Between this pair of headers 11, a number of horizontally disposed flat tubes 12 as heat exchanging tubes are arranged in parallel with each other at certain intervals with opposite ends thereof communicated with the headers 11. Corrugated fins 13 are disposed between the adjacent flat tubes 12 and at the outside of the outermost flat tube 12, and a side plate 14 is provided at the outside of the outermost corrugated fin 13.

At the predetermined height position of one of the headers 11 of the heat exchanger main body 10, a flange-like partition 50 of a block flange 4 which will be detailed is provided. At the same height position as the aforementioned partition 50 in the other header 11, a partitioning plate 16 is provided. Both the headers 11 are partitioned at the same height by these partitions 50 and 16. The upper flat tubes 12 above these partitions 16 and 50 constitute a condensing portion 1, and the lower flat tubes 12 constitute a subcooling portion 2 independent to the aforementioned condensing portion 1.

Furthermore, at certain height positions in the headers 11 in the condensing portion 1, partitioning plates 17 for turning the refrigerant flow are provided. Thus, in the heat exchanger main body 10 of this embodiment, the condensing portion 1 is divided into three passes, i.e., First pass P1 to Third pass P3.

Furthermore, at the upper portion of the other header 11 of the heat exchanger main body 10, a condensing portion inlet 1*a* corresponding to the first pass P1 is provided. On the other hand, at the lower portion, a subcooling portion outlet 2*b* corresponding to the subcooling portion 2 is provided.

The receiver-tank 3 is provided with a tank main body 31 made of a vertically extending tubular member with an upper closed end and a lower opened end and an inlet-and-outlet forming member 32 attached to the lower opened end of the tank main body 31 so as to close the lower opened end.

At the lower surface side of the inlet-and-outlet forming member 32, an inlet convex stepped portion 35 is formed so as to protrude downwardly. In the convex stepped portion 35, a receiver-tank inlet 3*a* which communicates with the inside of the tank main body 31 is formed.

Furthermore, at the lower surface side of the inlet-and-outlet forming member 32, an outlet concave stepped portion 36 is formed so as to dented upwardly. In the concave stepped portion 36, a receiver-tank outlet 3*b* communicating with the inside of the tank main body 31 is formed.

This receiver-tank 3 is constituted such that the refrigerant flowed into the tank main body 31 via the inlet 3*a* is once stored in the tank main body 31 and then only the liquefied refrigerant flows out of the receiver-tank outlet 3*b*.

On the other hand, as shown in FIGS. 2 to 6, the block flange 4 is provided with a main body 41 and an embedding portion 42 integrally protruded sideways from the side surface of the main body 41.

At the upper surface of the flange main body 41, an inlet concave stepped portion 45 for fitting the inlet convex stepped portion 35 of the aforementioned receiver-tank 3 and an outlet convex stepped portion 46 for fitting the outlet concave stepped portion 36 of the aforementioned receiver-tank 3 are formed.

In the inside of this block flange 4, an inlet flow passage 4*a* for connecting the condensing portion 1 to the receiver-tank 3 in fluid communication and an outlet flow passage 4*b* for connecting the receiver-tank 3 to the subcooling portion 2 are provided.

The one end (inlet side end portion) of the inlet flow passage 4*a* is opened at the upper surface of the embedding portion 42, and the other end (outlet side end portion) is opened at the upper surface of the inlet concave stepped portion 45.

The inlet side half portion of this inlet flow passage 4*a* constitutes a refrigerant descent passage 40*a* inclined downwardly, and the outlet side half portion thereof constitutes a refrigerant ascent passage 40*b* ascended vertically.

Furthermore, in this inlet flow passage 4*a*, it is constituted such that the inlet side end portion is disposed at a position higher than the outlet side end portion.

In the outlet flow passage 4*b*, the one end (inlet side end portion) is opened at the upper surface of the outlet convex stepped portion 46, and the other end (outlet side end portion) is opened at the side outside surface of the embedding portion 42.

Furthermore, at the upper end periphery of the embedding portion 42 of the block flange 4, an outwardly extended flange-like partition piece 50 is integrally provided. This flange-like partition piece 50 has a peripheral configuration conforming to the inner periphery of the header 11.

Figure 7:
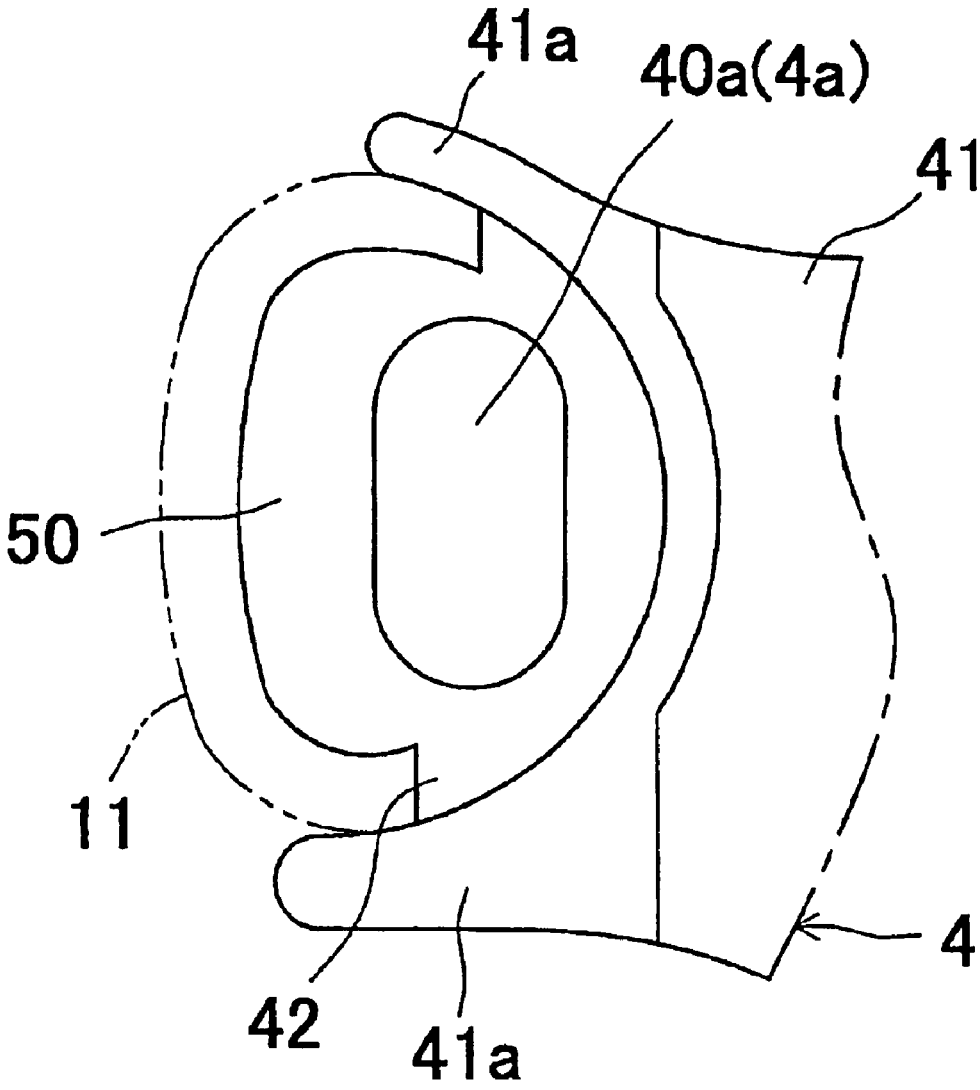
FIG. 7 is an enlarged plan view showing the circumference of the inlet port of the inlet flow passage and its vicinity of the block flange of the embodiment.
Figure 8:
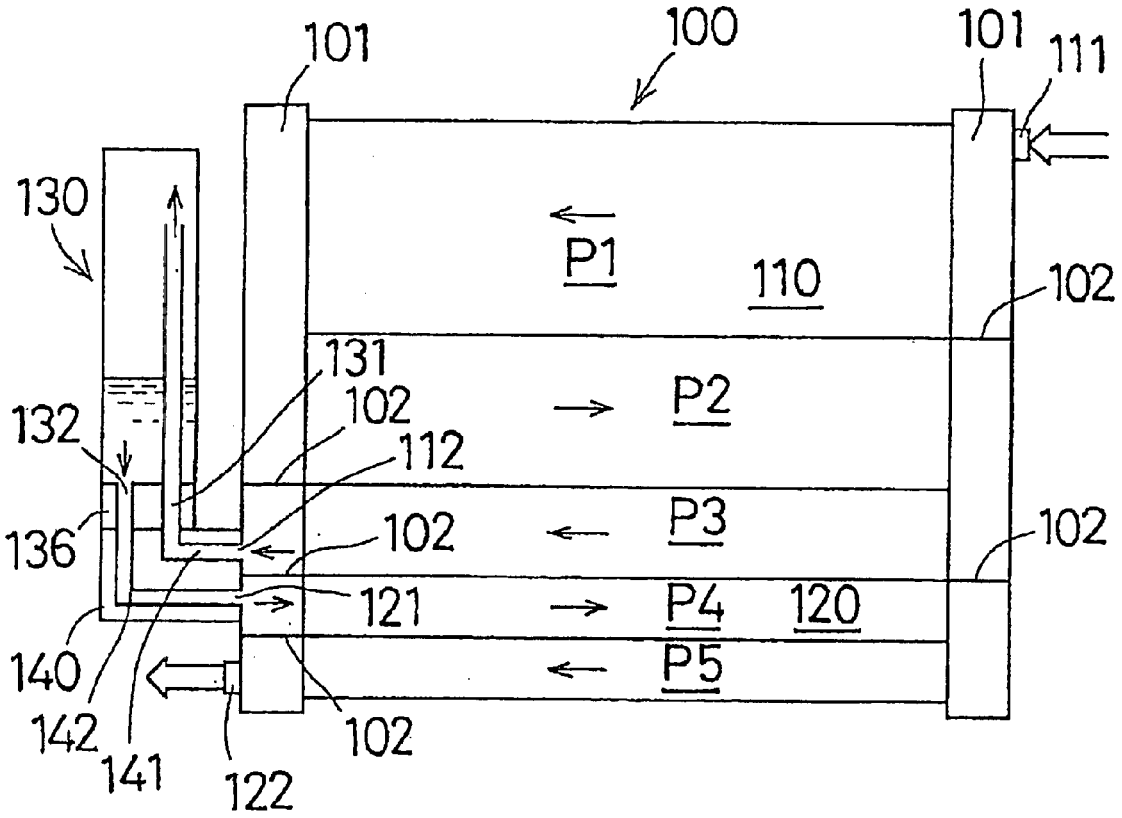
FIG. 8 is a schematic front view showing refrigerant flowing passes of a conventional heat exchanger with a receiver-tank.
Figure 9:
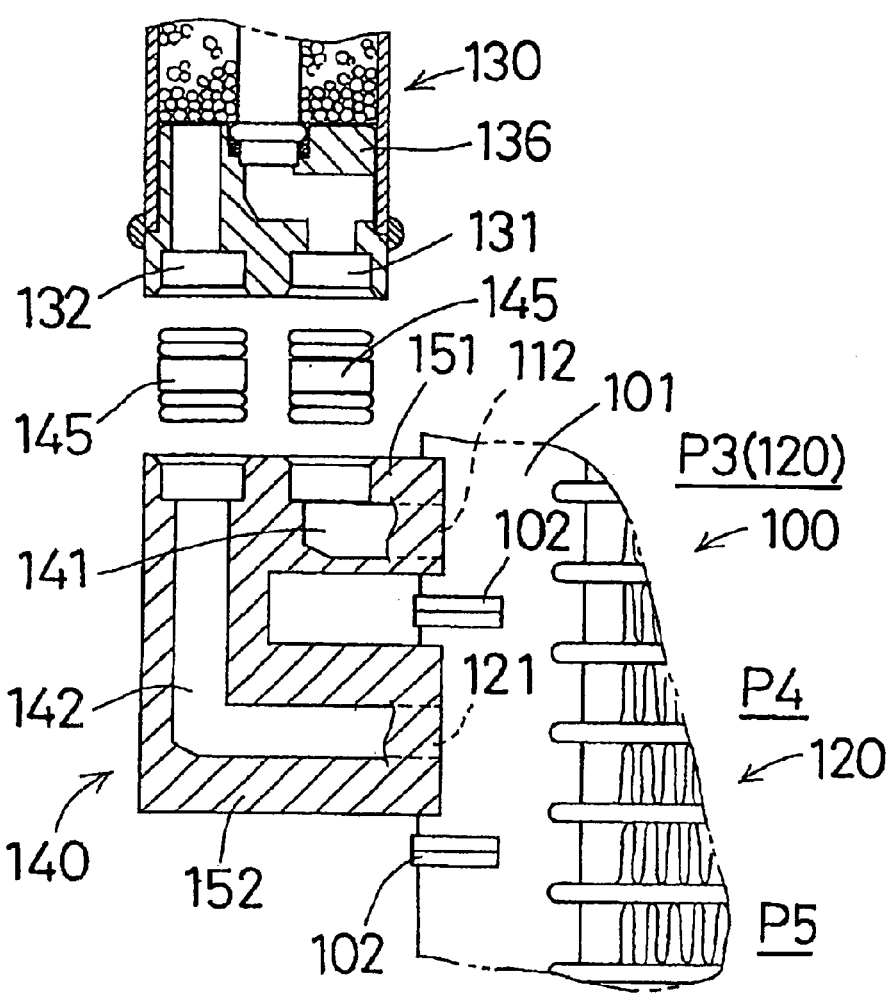
FIG. 9 is an explored front cross-sectional view showing the block flange and its vicinity of a conventional heat exchanger with a receiver-tank.

As shown in FIGS. 2 and 8, the embedding portion 42 of the block flange 4 is embedded between the condensing portion 1 and the subcooling portion 2 in the header 11, so that the peripheral portions 41*a* and 41*a* at the embedding portion side of the flange main body 41 are secured to the header 11 in an air-tight manner. Furthermore, as shown in FIGS. 2 and 7, the peripheral edge of the flange-like partition piece 50 at the upper end of the embedding portion is secured to the inner circumferential surface of the header 11 continuously along the circumferential direction. Thus, this flange-like partition piece 50 constitutes a partition for dividing the inside of the header 11 between the condensing portion 1 and the subcooling portion 2.

Furthermore, in this joining state, the inlet side end portion of the inlet flow passage 4*a* is opened to and communicates with the condensing portion 1 to thereby constitute a condensing portion outlet 1*b*, and the outlet side end portion of the outlet flow passage 4*b* is opened to and communicates with the subcooling portion 2 to thereby constitute a subcooling portion inlet 2*a*.

In this embodiment, the outlet side end portion of the inlet flow passage 4*a* is positioned at the height corresponding to the height of the upper end portion of the subcooling portion 2. Furthermore, the outlet side end portion of the inlet flow passage 4*a* is positioned at the height lower than the height of the inlet side end portion of the inlet flow passage 4*a*, i.e., the condensing portion outlet 1*b*.

As shown in FIGS. 2 and 3, the concave and convex stepped portions 35 and 36 of the aforementioned receiver-tank 3 are fitted to the concave and convex stepped portions 45 and 46 of the block flange 4 in an air-tight manner, so that the lower end of the receiver-tank 3 is attached to the block flange 4.

Furthermore, as shown in FIG. 1, the upper portion of the receiver-tank 3 is fixed to one of the headers 11 via a bracket 6.

In the heat exchanger with a receiver-tank of this embodiment, each core-constituting component, such as the header 11, the flat tube 12, the fin 13, the side plate 14, the receiver-tank 3 and the block flange 4, is made of aluminum (including its alloy) or constituted by an aluminum brazing sheet, etc. These components assembled via brazing members are brazed in a furnace.

In this embodiment, at the time of this brazing, the flange-like partition piece 50 of the block flange 4 is secured to the inner surface of the header 11.

The aforementioned heat exchanger with a receiver-tank is used as a condensing apparatus in a car air-conditioning refrigeration system together with a compressor, a decompressing means such as an expansion valve and an evaporator. In this refrigeration cycle, the gaseous refrigerant of high temperature and high pressure compressed by the compressor is introduced into the condensing portion 1 via the condensing portion inlet la and exchanges heat between the refrigerant and the ambient air while passing through the first to third passes P1 to P3 in a meandering manner.

This condensed refrigerant is introduced into the inlet flow passage 4*a* of the block flange 4 via the condensing portion outlet 1*b*, and passes through the inlet flow passage 4*a* to be introduced into the receiver-tank 3 from the receiver-tank inlet 3*a*.

The refrigerant introduced in the receiver-tank 3 is once stored in the tank, and only the liquefied refrigerant flows out of the receiver-tank outlet 3*b*, and it is introduced in the subcooling portion 2 via the outlet flow passage 4*b* from the outlet side end portion of the outlet flow passage 4*b*, i.e., the subcooling portion inlet 2*a*.

The liquefied refrigerant introduced in the subcooling portion 2 is subcooled by the ambient air while passing through the subcooling portion 2, and then it flows out through the subcooling portion outlet 2*b*.

In this way, the liquefied refrigerant flowed out of the heat exchanger with a receiver-tank is decompressed by the expansion valve, and then evaporated by absorbing hear from the ambient air. Then, the evaporated refrigerant returns to the aforementioned compressor. In this way, the refrigerant circulates in the refrigeration cycle of the refrigeration system, and a predetermined refrigeration performance can be obtained.

As mentioned above, according to the heat exchanger with a receiver-tank of this embodiment, since the block flange 4 for connecting a receiver-tank is secured the header 11 such that the embedding portion 42 is embedded in the header 11 of the heat exchanger main body 10, the installation space for the embedding portion 42 can be omitted, and therefore the miniaturization can be attained.

Furthermore, the flange-like partition piece 50 is integrally provided at the vicinity of the inlet of the inlet flow passage 4*a* at the upper end surface of the embedding portion 42, and the inside of the header 11 is divided by the partition piece 50 to thereby classify the core into the condensing portion 1 and the subcooling portion 2. Therefore, an additional partitioning member for partitioning the core into the condensing portion 1 and the subcooling portions 2 is not required to assemble, resulting in a reduced number of components and simplified assembling work, which in turn can reduce the manufacturing costs.

Furthermore, since a part 42 of the block flange 4 is embedded in one of the headers 11, the receiver-tank 3 to be joined to the block flange 4 can be approximated to the header 11 as much as possible, and therefore the entire heat exchanger can be further miniaturized.

Furthermore, in this embodiment, since the inlet side of the inlet flow passage 4*a* in the block flange 4 is inclined downward and the outlet side end portion of the inlet flow passage 4*a* is positioned lower than the inlet side end portion, the installation position of the receiver-tank 3 can be lowered, which enables to use a longer receiver-tank 3. Accordingly, the tank volume of the receiver-tank 3 can be kept large enough, the stable range in the subcooling state of a refrigerant can be enlarged, the excess and shortage of the sealed amount of refrigerant can be prevented, the stable refrigeration performance can be obtained, and therefore the refrigeration performance can be improved.

Furthermore, since a longer tank can be used as the receiver-tank 3, a tank having smaller diameter can be used while keeping enough tank volume, which in turn can miniaturize the receiver-tank 3.

Furthermore, in this embodiment, since the descent passage 40*a* in the inlet flow passage 4*a* of the block flange 4 is inclined to the axis of the header 11 and the upper end opening of the descent passage 40*a* is disposed perpendicularly to the axis of the header 11, the upper end opening area of the descent passage 40*a* can be formed larger than the flow passage area in the middle of the descent passage 40*a*. Thus, since the upper end opening area of the descent passage 40*a* can be formed larger, the refrigerant can be introduced smoothly and efficiently, the pressure loss can be reduced and the refrigerant can be supplied more stably, and therefore the refrigeration performance can be further improved.

Just for reference, in this embodiment, the upper end opening area (condensing portion outlet 1*b*) of the descent passage 40*a* is set to be about 62 $mm^2$.

In the aforementioned embodiment, although the present invention was explained by exemplifying the case where the invention is applied to the heat exchanger with a receiver-tank in which the subcooling portion is formed in the heat exchanger main body, the so-called subcool system condenser, the present invention is not limited to the above. The present invention can also be applied to a heat exchanger in which a condenser and a subcooler are provided separately and a heat exchanger with a receiver-tank in which a subcooling portion is not formed in a heat exchanger main body such as a condenser with a receiver-tank.

Furthermore, in the aforementioned embodiment, although the inlet-and-outlet forming member is formed apart from the tank main body, the present invention is not limited to it, but can also be applied to the one in which an inlet-and-outlet forming member is integrally provided to a tank main body.

Furthermore, needless to say, neither the number of passes of the heat exchanger main body nor the number of heat exchanging tubes of each pass is limited to the above.

As mentioned above, according to the present invention, since the receiver-tank joint member is secured to the header of the heat exchanger main body in the state where the embedding portion is embedded in the header, the installation space of the embedding portion can be omitted, therefore the miniaturization can be attained. Furthermore, since the flange-like partition piece is integrally provided at the vicinity of the inlet flow passage at the upper surface of the embedded portion to thereby divide the inside of one of the headers, it is not necessary to attach an additional partition for dividing the inside of the header. Thus, the number of components can be reduced and the assembling work can be performed easily, resulting in reduced costs. Furthermore, since a part of a joint member is embedded in one of headers, the receiver-tank to be attached to the joint member can be further approached to the header, which can further miniaturize the assembly.

In the present invention, in cases where the inflow side of the inlet flow passage in the joint member is formed downwardly, since the outlet side end portion of the inlet flow passage can be positioned lower than the inlet side end portion, the installation position of the receiver-tank to be attached can be positioned lower. Therefore, a longer receiver-tank can be used. Accordingly, the tank volume of the receiver-tank can be kept large enough, the stable range in the subcooling state of the refrigerant can become larger, the excess and shortage of the sealed amount of the refrigerant can be prevented and the stable refrigeration performance can be obtained. Thus, the refrigeration performance can be further improved. Furthermore, since a longer tank can be used as the receiver-tank, a tank having smaller diameter can be used while keeping enough tank volume. Thus, a further miniaturization can be attained.

Furthermore, in the present invention, in cases where the descent passage in the inlet flow passage of the joint member is inclined to the axis of the header, the upper end opening area of the descent passage can be formed larger. Accordingly, the refrigerant can be introduced smoothly and efficiently, the pressure loss can be reduced, the refrigerant can be supplied in a more stabilized manner, and the refrigeration performance can be further improved.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

Industrial Applicability

As mentioned above, according to the refrigeration system and its condensing apparatus of the present invention, since miniaturization can be attained while keeping the excellent performance, it can be suitably used especially for a car air-conditioning refrigeration apparatus.

What is claimed is:

1. A heat exchanger with a receiver-tank, comprising:

a heat exchanger main body including a pair of headers and a plurality of heat exchanging tubes disposed in parallel with opposite ends thereof communicated with said headers, wherein a refrigerant is condensed by a condensing portion constituted by said heat exchanging tubes;

a receiver-tank provided with a receiver-tank inlet and a receiver-tank outlet at a lower end thereof, wherein the refrigerant introduced via said receiver-tank inlet is stored and only the liquefied refrigerant flows out of said receiver-tank outlet; and a joint member for connecting said receiver-tank to one of said pair of headers, wherein said joint member includes a joint member main body to be attached to a lower end of said receiver-tank, an embedding portion provided at a side portion of said joint main body to be embedded in said one of said pair of headers, and an inlet flow passage having an inlet side end portion disposed at an upper end surface of said embedding portion to be communicated with said condensing portion and an outlet side end portion disposed at an upper end surface of said joint member main body to be communicated with said receiver-tank inlet, and wherein a flange-like partition piece protruded outwardly is integrally formed at an upper end periphery of said embedding portion of said joint member, a peripheral edge of said flange-like partition piece being joined to an inner peripheral surface of said one of said pair of headers, and an inside of said one of said pair of headers being divided by said flange-like partition piece, whereby the refrigerant condensed by said condensing portion is introduced into an inside of said receiver-tank via said inlet side end portion of said inlet flow passage in said joint member.

2. The heat exchanger with a receiver-tank as recited in claim 1, wherein said outlet side end portion of said inlet flow passage of said joint member is positioned lower than said inlet side end portion.

3. The heat exchanger with a receiver-tank as recited in claim 1, wherein an inlet side half portion of said inlet flow passage of said joint member is formed as a refrigerant descent passage for descending the refrigerant downward.

4. The heat exchanger with a receiver-tank as recited in claim 3, wherein said refrigerant descent passage is disposed so that a passage direction thereof is inclined to an axis of said one of said pair of headers.

5. The heat exchanger with a receiver-tank as recited in claim 1, wherein an outlet side half portion of said inlet flow passage of said joint member is formed as a refrigerant ascent passage for raising the refrigerant upward.

6. The heat exchanger with a receiver-tank as recited in claim 5, wherein said refrigerant ascent passage is disposed so that a passage direction thereof is approximately parallel to an axis of said one of said pair of headers.

7. A heat exchanger with a receiver-tank, comprising:

a heat exchanger main body including a pair of spaced headers and a plurality of heat exchanging tubes disposed in parallel with opposite ends thereof communicated with said headers, wherein an inside of each of said headers is divided at the same height to thereby form an upper side condensing portion and a lower side subcooling portion;

a receiver-tank provided with a receiver-tank inlet and a receiver-tank outlet at a lower end thereof, wherein the refrigerant introduced via said receiver-tank inlet is stored and only the liquefied refrigerant flows out of said receiver-tank outlet; and a joint member for connecting said receiver-tank to one of said pair of headers, wherein said joint member includes a joint member main body to be attached to a lower end of said receiver-tank, an embedding portion provided at a side portion of said joint member main body to be embedded in said one of said pair of headers, an inlet flow passage having an inlet side end portion disposed at an upper end surface of said embedding portion to be communicated with said condensing portion and an outlet side end portion disposed at an upper end surface of said joint member main body to be communicated with said receiver-tank inlet, and an outlet flow passage having an inlet side end portion disposed at an upper end surface of said joint member main body to be communicated with said receiver-tank outlet and an outlet side end portion disposed at a portion below said embedding portion to be communicated with said subcooling portion, and wherein a flange-like partition piece protruded outwardly is integrally formed at an upper end periphery of said embedding portion of said joint member, said flange-like partition piece constituting as said partition of said one of said pair of headers, whereby the refrigerant condensed by said condensing portion is introduced into an inside of said receiver-tank via said inlet side end portion of said inlet flow passage in said joint member, and the refrigerant in said receiver-tank is introduced into said subcooling portion from said outlet side end portion of said outlet flow passage through said outlet flow passage of said joint member.

8. The heat exchanger with a receiver-tank as recited in claim 7, wherein said outlet side end portion of said inlet flow passage of said joint member is positioned lower than said inlet side end portion.

9. The heat exchanger with a receiver-tank as recited in claim 7, wherein said outlet side end portion of said inlet flow passage of said joint member is disposed at a height corresponding to said subcooling portion.

10. The heat exchanger with a receiver-tank as recited in claim 7, wherein an inlet side half portion of said inlet flow passage of said joint member is formed as a refrigerant descent passage for downwardly descending the refrigerant.

11. The heat exchanger with a receiver-tank as recited in claim 10, wherein said refrigerant descent passage is disposed so that a passage direction thereof is inclined to an axis of said one of said pair of headers.

12. The heat exchanger with a receiver-tank as recited in claim 7, wherein an outlet side half portion of said inlet flow passage of said joint member is formed as a refrigerant ascent passage for raising the refrigerant upward.

13. The heat exchanger with a receiver-tank as recited in claim 12, wherein said refrigerant ascent passage is disposed so that a passage direction thereof is approximately parallel to an axis of said one of said pair of headers.

14. A receiver-tank joint member for connecting a receiver-tank for storing a liquefied refrigerant to a heat exchanger main body including a pair of headers and a plurality of heat exchanging tubes arranged in parallel with opposite ends thereof communicated with said headers, said heat exchanger main body having a condensing portion formed by said plurality of heat exchanging tubes, said receiver-tank joint member, comprising:

a joint member main body to which a lower end of said receiver-tank is to be attached;

an embedding portion provided at a side portion of said joint member main body to be embedded in one of said pair of headers;

an inlet flow passage for communicating said condensing portion with said receiver-tank inlet at a lower end of said receiver-tank, said inlet flow passage having an inlet side end portion disposed at an upper end surface of said embedding portion and an outlet side end portion disposed at an upper end surface of said joint member main body; and a flange-like partition piece for dividing an inside of said one of said pair of headers, said flange-like partition piece being integrally protruded outwardly at an upper periphery of said embedding portion, said peripheral edge of said flange-like piece being joined to an inner peripheral surface of said one of said pair of headers.

15. The receiver-tank joint member as recited in claim 14, wherein said outlet side end portion of said inlet flow passage is positioned lower than said inlet side end portion.

16. The receiver-tank joint member as recited in claim 14, wherein an inlet side half portion of said inlet flow passage is formed as a refrigerant descent passage for downwardly descending the refrigerant.

17. The receiver-tank joint member as recited in claim 16, wherein said refrigerant descent passage is disposed so that a passage direction thereof is inclined to an axis of said one of said pair of headers.

18. The receiver-tank joint member as recited in claim 14, wherein an outlet side half portion of said inlet flow passage is formed as a refrigerant ascent passage for raising the refrigerant upward.

19. The receiver-tank joint member as recited in claim 18, wherein said refrigerant ascent passage is disposed so that a passage direction thereof is approximately parallel to an axis of said one of said pair of headers.

20. A receiver-tank joint member for connecting a receiver-tank for storing a liquefied refrigerant to a heat exchanger main body including a pair of headers and a plurality of heat exchanging tubes arranged in parallel with opposite ends thereof communicated with said headers, said heat exchanger main body having an upper condensing portion and a lower subcooling portion divided by partitions provided at the same level, said receiver-tank joint member, comprising:

a joint member main body to which a lower end of said receiver-tank is to be attached;

an embedding portion provided at a side portion of said joint member main body to be embedded in one of said pair of headers;

an inlet flow passage for communicating said condensing portion with said receiver-tank inlet at a lower end of said receiver-tank, said inlet flow passage having an inlet side end portion disposed at an upper end surface of said embedding portion and an outlet side end portion disposed at an upper end surface of said joint member main body;

an outlet flow passage for communicating said receiver-tank outlet at a lower end of said receiver-tank with said subcooling portion, said inlet flow passage having an inlet side end portion disposed at an upper end surface of said joint member main body and an outlet side end portion disposed at a portion below said embedded portion; and a flange-like partition piece constituting said partition in said one of said pair of headers, said flange-like partition piece being integrally protruded outwardly at an upper periphery of said embedding portion.

21. The receiver-tank joint member as recited in claim 20, wherein said outlet side end portion of said inlet flow passage is positioned lower than said inlet side end portion.

22. The receiver-tank joint member as recited in claim 20, wherein said outlet side end portion of said inlet flow passage is positioned at a height corresponding to said subcooling portion.

23. The receiver-tank joint member as recited in claim 20, wherein an inlet side half portion of said inlet flow passage is formed as a refrigerant descent passage for downwardly descending the refrigerant.

24. The receiver-tank joint member as recited in claim 23, wherein said refrigerant descent passage is disposed so that a passage direction thereof is inclined to an axis of said one of said pair of headers.

25. The receiver-tank joint member as recited in claim 20, wherein an outlet side half portion of said inlet flow passage is formed as a refrigerant ascent passage for raising the refrigerant upward.

26. The receiver-tank joint member as recited in claim 25, wherein said refrigerant ascent passage is disposed so that a passage direction thereof is approximately parallel to an axis of said one of said pair of headers.

27. The receiver-tank assembling structure as recited in claim 26, wherein an inlet side half portion of said inlet flow passage is formed as a refrigerant descent passage for downwardly descending the refrigerant.

28. The receiver-tank assembling structure as recited in claim 27, wherein said refrigerant descent passage is disposed so that a passage direction thereof is inclined to an axis of said one of said pair of headers.

29. A receiver-tank assembling structure of a heat exchanger for assembling a receiver-tank for storing a liquefied-refrigerant to a heat exchanger main body including a pair of headers and a plurality of heat exchanging tubes arranged in parallel with opposite ends thereof communicated with said headers, said heat exchanging tubes constituting a condensing portion, said receiver-tank assembling structure, comprising:

a joint member including a joint member main body and an embedding portion provided at a side portion of said main body, wherein said joint member is provided with an inlet flow passage with an inlet side end portion disposed at an upper end surface of said embedding portion and an outlet side end portion disposed at an upper end surface of said joint member main body and a flange-like partition piece integrally protruded from an upper end periphery of said embedding portion, wherein said joint member is attached to said one of said pair of headers in the state that said embedded portion is embedded in said one of said pair of headers, and a peripheral edge of said flange-like partition piece is joined to an inner peripheral surface of said one of said pair of headers so that an inside of said one of said pair of headers is divided by said flange-like partition piece, and wherein a lower end of said receiver-tank is attached to said joint member main body, whereby said condensing portion communicates with said receiver-tank inlet at a lower end of said receiver-tank by said inlet flow passage.

30. The receiver-tank assembling structure as recited in claim 29, wherein said outlet side end portion of said inlet flow passage is positioned lower than said inlet side end portion.

31. The receiver-tank assembling structure as recited in claim 29, wherein an outlet side half portion of said inlet flow passage is formed as a refrigerant ascent passage for raising the refrigerant upward.

32. The receiver-tank assembling structure as recited in claim 31, wherein said refrigerant ascent passage is disposed so that a passage direction thereof is approximately parallel to an axis of said one of said pair of headers.

33. A receiver-tank assembling structure of a heat exchanger for assembling a receiver-tank for storing a liquefied-refrigerant to a heat exchanger main body including a pair of headers and a plurality of heat exchanging tubes arranged in parallel with opposite ends thereof communicated with said headers, said heat exchanger main body having an upper condensing portion and a lower subcooling portion divided by a partition disposed in an inside of said headers at the same height, said receiver-tank assembling structure, comprising:

a joint member including a joint member main body and an embedding portion provided at a side portion of said main body, wherein said joint member is provided with an inlet flow passage with an inlet side end portion disposed at an upper end surface of said embedding portion and an outlet side end portion disposed at an upper end surface of said joint member main body, an outlet flow passage with an inlet side end portion disposed at an upper end surface of said joint member main body and an outlet side end portion disposed at a portion below said embedding portion, and a flange-like partition piece integrally protruded from an upper end periphery of said embedding portion, wherein said joint member is attached to said one of said pair of headers in the state that said embedded portion is embedded in said one of said pair of headers and a peripheral edge of said flange-like partition piece is joined to an inner peripheral surface of said one of said pair of headers so that said flange-like partition constitutes as said partition in said one of said pair of headers, and wherein a lower end of said receiver-tank is attached to said joint member main body, whereby said condensing portion communicates with said receiver-tank inlet at a lower end of said receiver-tank via said inlet flow passage, and said receiver-tank outlet at a lower end of said receiver-tank communicates with said subcooling portion via said outlet flow passage.

34. The receiver-tank assembling structure as recited in claim 33, wherein said outlet side end portion of said inlet flow passage is positioned lower than said inlet side end portion.

35. The receiver-tank assembling structure as recited in claim 33, wherein said outlet side end portion of said inlet flow passage is positioned at a height corresponding to said subcooling portion.

36. The receiver-tank assembling structure as recited in claim 33, wherein an inlet side half portion of said inlet flow passage is formed as a refrigerant descent passage for downwardly descending the refrigerant.

37. The receiver-tank assembling structure as recited in claim 36, wherein said refrigerant descent passage is disposed so that a passage direction thereof is inclined to an axis of said one of said pair of headers.

38. The receiver-tank assembling structure as recited in claim 33, wherein an outlet side half portion of said inlet flow passage is formed as a refrigerant ascent passage for raising the refrigerant upward.

39. The receiver-tank assembling structure as recited in claim 38, wherein said refrigerant ascent passage is disposed so that a passage direction thereof is approximately parallel to an axis of said one of said pair of headers.

40. A refrigeration system in which a refrigerant compressed by a compressor is condensed by a heat exchanger with a receiver-tank, the condensed refrigerant is passed through a decompressing device to be decompressed and the decompressed refrigerant is evaporated by an evaporator and then returned to said compressor, wherein said heat exchanger with a receiver-tank comprises:

a heat exchanger main body including a pair of headers and a plurality of heat exchanging tubes disposed in parallel with opposite ends thereof communicated with said headers, wherein a refrigerant is condensed by a condensing portion constituted by said heat exchanging tubes;

a receiver-tank provided with a receiver-tank inlet and a receiver-tank outlet at a lower end thereof, wherein the refrigerant introduced via said receiver-tank inlet is stored and only the liquefied refrigerant flows out of said receiver-tank outlet; and a joint member for connecting said receiver-tank to one of said pair of headers, wherein said joint member includes a joint member main body to be attached to a lower end of said receiver-tank, an embedding portion provided at a side portion of said joint main body to be embedded in said one of said pair of headers, and an inlet flow passage having an inlet side end portion disposed at an upper end surface of said embedding portion to be communicated with said condensing portion and an outlet side end portion disposed at an upper end surface of said joint member main body to be communicated with said receiver-tank inlet, and wherein a flange-like partition piece protruded outwardly is integrally formed at the upper end periphery of said embedding portion of said joint member, a peripheral edge of said flange-like partition piece being joined to an inner peripheral surface of said one of said pair of headers, and an inside of said one of said pair of headers being divided by said flange-like partition piece.

41. A refrigeration system in which a refrigerant compressed by a compressor is condensed by a heat exchanger with a receiver-tank, the condensed refrigerant is passed through a decompressing device to be decompressed and the decompressed refrigerant is evaporated by an evaporator and then returned to said compressor, wherein said heat exchanger with a receiver-tank comprises:

a heat exchanger main body including a pair of headers and a plurality of heat exchanging tubes disposed in parallel with opposite ends thereof communicated with said headers, wherein an inside of each of said headers is divided at the same height to thereby form an upper side condensing portion and a lower side subcooling portion;

a receiver-tank provided with a receiver-tank inlet and a receiver-tank outlet at a lower end thereof, wherein the refrigerant introduced via said receiver-tank inlet is stored and only the liquefied refrigerant flows out of said receiver-tank outlet; and a joint member for connecting said receiver-tank to one of said pair of headers, wherein said joint member includes a joint member main body to be attached to a lower end of said receiver-tank, an embedding portion provided at a side portion of said joint main body to be embedded in said one of said pair of headers, an inlet flow passage having an inlet side end portion disposed at an upper end surface of said embedding portion to be communicated with said condensing portion and an outlet side end portion disposed at an upper end surface of said joint member main body to be communicated with said receiver-tank inlet, and an outlet flow passage having an inlet side end portion disposed in an upper end surface of said joint member main body to be communicated with said receiver-tank outlet and an outlet side end portion disposed at a portion below said embedding portion to be communicated with said subcooling portion, and wherein a flange-like partition piece protruded outwardly is integrally formed at an upper end periphery of said embedding portion in said joint member, said flange-like partition piece being constituted as said partition of said one of said pair of headers.

* * * * *